United States Patent [19]

Rouire

[11] Patent Number: 5,036,988

[45] Date of Patent: Aug. 6, 1991

[54] BOOKEND FOR METAL SHELVES

[76] Inventor: Michel Rouire, 102 Harrowby Avenue, Winnipeg, Manitoba, Canada, R2M OH2

[21] Appl. No.: 538,769

[22] Filed: Jun. 15, 1990

[51] Int. Cl.[5] ..... A47B 65/00

[52] U.S. Cl. ..... 211/42; 211/43

[58] Field of Search ..... 248/206.5, 174, 445, 248/446, 447.1, 459, 145.6, 416, 441.1; 2121/42, 43, DIG. 1; 52/DIG. 4

[56] References Cited

U.S. PATENT DOCUMENTS

| | | | |
|---|---|---|---|
| 1,396,910 | 11/1921 | Annable | 211/42 X |
| 2,117,668 | 5/1938 | Johnson | 211/53 X |
| 3,604,564 | 9/1971 | Weyll, Jr. | 211/43 |
| 3,974,918 | 8/1976 | Yaremchuk | 211/43 |

*Primary Examiner*—Carl D. Friedman
*Assistant Examiner*—Korie Chan
*Attorney, Agent, or Firm*—Adrian D. Battison; Stanley G. Ade; Murray E. Thrift

[57] ABSTRACT

A bookend for use on a metal shelf is formed by bending from a single sheet of metal to form an upstanding plate and flat tongue so that the tongue can lie on the metal shelf with the plate upstanding. The tongue includes an extension portion extending to the opposed side of the plate relative to the main part of the tongue with an upstanding handle on the end of the extension portion. The underside of the tongue carries a layer of resilient felt surrounding an elongate central magnetic strip which extends substantially along the full length of the tongue. The magnetic is sufficient to provide additional friction between the bookend and the shelf to prevent toppling under the weight of the book.

1 Claim, 1 Drawing Sheet

BOOKEND FOR METAL SHELVES

BACKGROUND OF THE INVENTION

This invention relates to a bookend which is particularly designed for use with metal shelves.

Many different designs of bookends are available for library use and one common type comprises a single sheet of metal which is cut and bent to form an upstanding plate member and a tongue at right angle from the plate member so the tongue can lie on the shelf with the plate member standing therefrom.

The end of the row of books is then placed upon the tongue and rests against the plate member. Various layers are applied to the underside of the tongue to assist in adhesion to the shelf and often a felt layer is applied in this area since this prevents scratching and can in many cases provide the required friction. Devices of this type are entirely satisfactory with wooden shelves since the amount of friction between the felt and the wood is sufficient to prevent the weight of the books against the plate member from causing the whole unit to slide along the shelf until the bookend is expelled from the end face of the end book.

Most libraries that now are using metal shelves to store books. One common problem that has arisen with metal shelves is that the bookends of this type do not have sufficient friction to remain in place and collapse so they become effectively valueless.

Many attempts have been made to solve this problem including different layers on the underside, the use of entirely different bookend constructions which use a mechanical coupling with the shelf to lock the bookend in place. These devices of course do not have the problem of toppling but are difficult and inconvenient to operate and the inexperienced persons using the library are often unable to find out how to work it.

It is one object of the present invention therefore, to provide an improved bookend which resolves the problem of sliding on a metal shelf.

According, to the invention, therefore, there is provided a bookend for use on a metal shelf comprising a upstanding plate member for engaging against an end face of a row of books on the shelf to support the book from toppling toward the plate member, a substantially flat tongue connected to the plate member at right angles thereto so to extend underneath a lower edge of one or more of the row of books, and a strip magnet mounted on an underside of the tongue so to provide a coupling force between the tongue and the shelf to inhibit sliding of the tongue on the shelf.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different Figures.

DETAILED DESCRIPTION

Figure 2:
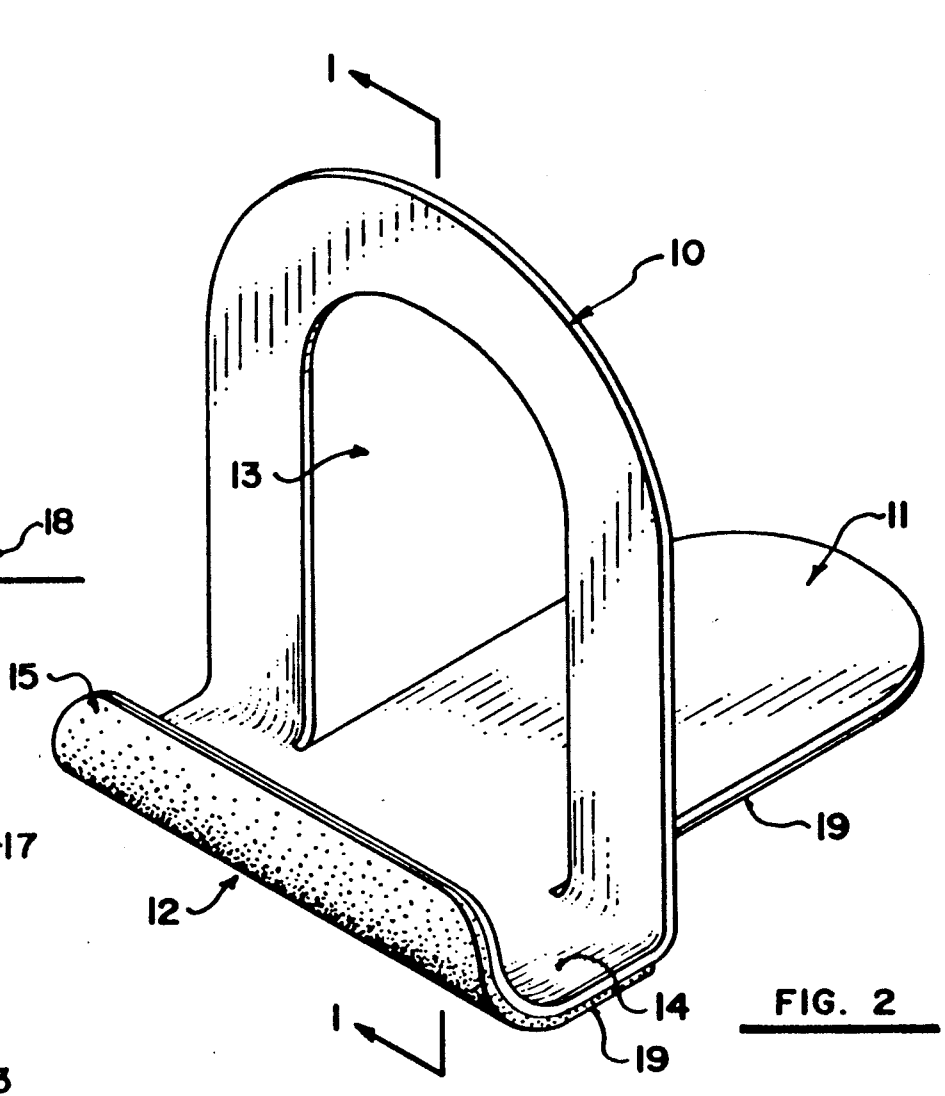
FIG. 2 is an isometric view of the bookend of FIG. 1.
Figure 1:
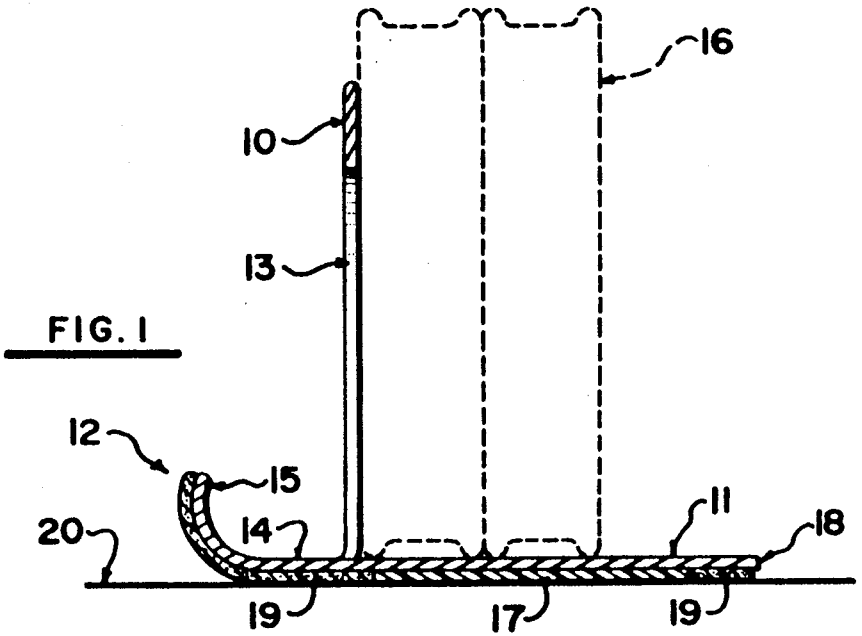
FIG. 1 is a cross sectional view of a bookend according the invention taking along the lines 1–1 of FIG. 2.
Figure 3:
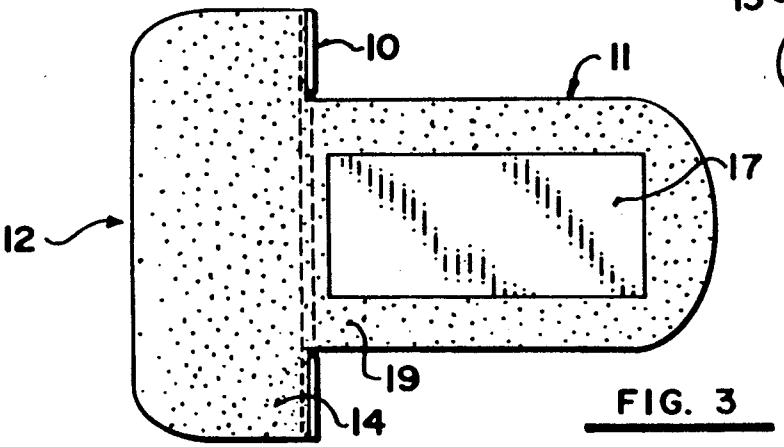
FIG. 3 is an underside view of the bookend of FIG. 1.

The bookend is formed from a single sheet of metal which is bent to form a plate member 10 which will in use upstand from the shelf, a tongue 11 and a forward plate portion 12. The tongue is formed by cutting an opening 13 in the plate member and bending the tongue portion downwardly at right angles to the plate member. The forward plate portion 12 forms the full width of the plate member but is bent forwardly at right angles therefrom as indicated at 14 and then turns upwardly as indicated at 15 to define a handle which can be grasped by the user as it is freely exposed at the end of the row of books indicated at 16.

On the underside of the tongue 11 is attached a strip magnet 17 in the form of a rectangular strip of a thin flexible magnetic material. The strip is formed so it has a width slightly less than that of the tongue and extends substantially the full length of the tongue from the base of the plate member 10 to a position closely adjacent an outer end 18 of the tongue. Surrounding the strip magnet is provided a layer of a felt material 19 which provides a resilient layer which is a thickness substantially equal to the thickness of the magnetic strip so that both the felt on the magnetic strip can lie upon the shelf surface indicated at 20. The magnetic strip is attached by adhesive to the underside of the tongue with the edges of the felt abutting closely to the edges of the magnetic strip. The thickness of the felt and of the magnetic strip can be of the order of 1/16 inch.

The magnetic strip provides sufficient coupling force between the tongue and the shelf to increase the friction between the tongue and the shelf sufficiently to prevent it sliding and of the forces from the row of books. At the same time the handle 15 allows the unit to be readily removed from underneath the end of the row of books or sufficient force to be applied in a sliding direction to move it away from the end of the row of books to insert further books if required.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A bookend for use on a metal shelf comprising an upstanding plate member for engaging against an end face of a row of books on the shelf to support the books against toppling toward the plate, a substantially flat elongate tongue connected to the plate member at right angles thereto so to extend underneath a lower edge of one or more of the row of books, and an elongate strip magnet mounted on an underside surface of the tongue so to provide a coupling force between the tongue and the shelf to inhibit sliding of the tongue on the shelf, the strip magnet extending substantially the full length of the tongue, and being spaced from side edges of the underside surface a resilient layer on the underside surface of the tongue surrounding the strip magnet and substantially of the same thickness as the strip magnet, a further plate portion extending substantially in the plane of the tongue on the side of the plate member opposed to the tongue, a handle defined by a portion of the further plate portion turned upwardly at an end thereof spaced from the plate member to allow manual grasping, the further plate portion, the tongue and the plate member being formed from a single sheet of metal with the tongue being formed by a portion cut out of a center of the plate member and bent downwardly out of the plane thereof to a position at right angles thereto.

* * * * *